United States Patent [19]

Cline

[11] Patent Number: 4,709,927

[45] **Date of Patent: * Dec. 1, 1987**

[54] GAME BOARD CONSTRUCTION

[75] Inventor: Thomas L. Cline, Hanover, Pa.

[73] Assignee: Corra-Board Products Co., Inc., Hanover, Pa.

[ * ] Notice: The portion of the term of this patent subsequent to Dec. 1, 2004 has been disclaimed.

[21] Appl. No.: 907,416

[22] Filed: Sep. 15, 1986

[51] Int. Cl.[4] ..... A63F 3/00; B32B 3/28; B32B 7/02

[52] U.S. Cl. ..... 273/286; 273/287; 428/182; 428/212

[58] Field of Search ..... 428/182, 212, 166, 184, 428/138; 273/287, 108, 285, 286

[56] References Cited

U.S. PATENT DOCUMENTS

| | | | |
|---|---|---|---|
| 1,535,503 | 4/1925 | Spaeder | 273/285 |
| 2,157,589 | 5/1939 | Bullen et al. | 273/236 |
| 2,176,258 | 10/1939 | Griffith | 273/287 |
| 3,892,409 | 7/1975 | Herbert | 273/271 |
| 3,899,176 | 8/1975 | Gregan | 273/287 |
| 4,113,255 | 9/1978 | Goldfarb et al. | 273/108 |
| 4,262,050 | 4/1981 | Jenkins | 428/138 |

*Primary Examiner*—Richard C. Pinkham
*Assistant Examiner*—Benjamin Layno
*Attorney, Agent, or Firm*—Daniel J. O'Connor

[57] ABSTRACT

This invention relates generally to a game board having a particular novel layered construction. In place of a conventional solid chipboard laminated construction, an undulated midstratum layer is utilized in such manner that air cells or pockets are formed within the structure. An overlayer and an underlayer are adhesively applied to the undulated midstratum layer. The invention results in a game board which may be much more economically manufactured while yielding superior end product strength and durability.

1 Claim, 3 Drawing Figures

GAME BOARD CONSTRUCTION

BACKGROUND AND OBJECTS OF THE INVENTION

This application is generally related to copending U.S. application Ser. No. 06/897,255 now U.S. Pat. No. 4,673,608; Ser. Nos. 06/900,988; 06/904,668; 06/909,569; and 06/911,727.

As is known in the game board manufacturing industry, game boards 10 generally have a solid left panel 20 and a solid right panel 21 with a foldable middle section 25 as shown in FIG. 1.

The left and right panels 20 and 21 typically are formed of a multi-layered solid laminated chipboard as shown in the prior art drawing of FIG. 2B.

The laminated solid chipboard structures of the prior art typically comprise five or more layers, three of which are shown at 31, 32, and 33 of FIG. 2B. Each layer must be fully joined to an adjacent layer by adhesives 35 as is known in the art.

Chipboard is a term known to those of skill in the art to signify paper products processed from, for example, waste paper materials and thus having relatively short fiber lengths contained therein as shown at numerals 40 in the prior art showing at FIG. 2B.

Because chipboard is, by definition, formed of short fiber length materials, it inherently has low original position memory. That is, once bent, chipboard is unable to successfully return to its original desired flat position. Because of such low memory by chipboard products, it has been required to utilize five or more chipboard layers in the formation of game boards. The required usage of such a high number of chipboard layers has increased adhesives costs and manufacturing time and materials costs generally.

Accordingly, it is an object of the present invention to provide a game board structure which is less costly to manufacture and ship than the conventionally used laminated solid chipboard design.

It is a further object to reduce manufacturing costs by effectively using air cells within the game board assembly to reduce overall materials costs.

It is a still further object of the invention to significantly reduce the cost of adhesives used in the production of game boards.

It is a further object to demonstrate a game board construction which can be bent without the cracking inherent in prior art designs.

It is a still further object to provide a game board construction which has a higher original position memory than has been heretofore known in the art.

It is a further significant object of the present invention to produce a game board having the same or increased thickness as prior art designs while decreasing panel weight and improving panel durability.

It is also an object of the invention to demonstrate an advantageous game board construction which utilizes an undulated midstratum layer having significantly longer average fiber lengths relative to an overlayer and underlayer which are formed of chipboard materials having significantly shorter average fiber lengths therein.

Further objects and advantages of the present invention will become apparent as the following description proceeds, and the features of novelty characterizing the invention will be pointed out with particularity.

PRIOR ART PATENTS

The most relevant prior art patents presently known to the inventor herein are listed as follows: U.S. Pat. No. 2,157,589 issued to Bullen; U.S. Pat. No. 2,176,258 issued to Griffith; U.S. Pat. No. 3,899,176 issued to Gregan; and U.S. Pat. No. 4,421,312 issued to Delgado.

The above-cited patents illustrate the paperboard game board structures of the prior art wherein, typically, layers of chipboard are built up to form a solid element suitable for use with various game pieces as shown in the prior art FIG. 2B of the present application.

Prior art systems which utilized a solid wood game board structure are, of course, no longer practical to manufacture and ship on a large-scale basis because of the prohibitive costs involved.

While the solid laminated chipboard layers currently used in the game board arts have served a useful purpose, the invention disclosed herein demonstrates a game board construction of superior durability and yet lower weight to reduce shipping and manufacturing materials costs. Natural resources are also conserved since less paper and wood products are required for production of a game board having the caliper or thickness required for acceptance in the art. With millions of game boards being sold annually, the savings in natural resource usage is a highly significant advantage of the present invention.

BRIEF DESCRIPTION OF THE DRAWING FIGURES

DESCRIPTION OF THE PREFERRED EMBODIMENT

Figure 2A:
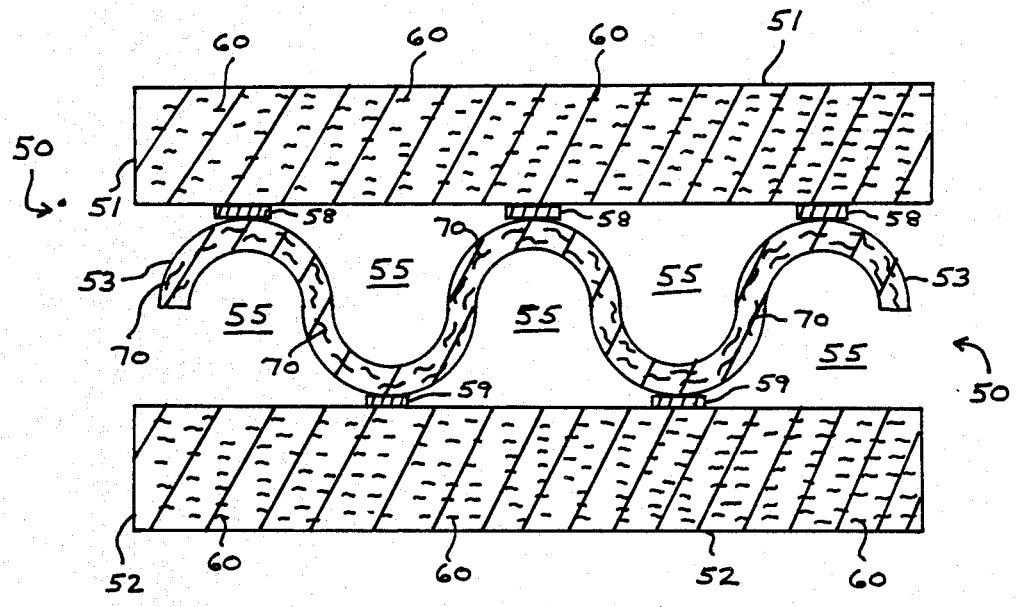
FIG. 2A is a view along lines 2—2 of FIG. 1 illustrating the construction details of the present invention.

As shown in FIG. 2A, the game board construction of the present invention comprises an overlayer 51 of chipboard having relatively shorter fiber lengths 60 contained therein. Underlayer 52 also comprises chipboard material with corresponding shorter fiber lengths 60.

FIG. 2A further illustrates an undulated midstratum layer 53 wherein the upper undulation portions are bonded by adhesive 58 to overlayer 51. Similarly, the lower undulation portions are bonded by adhesive shown at 59.

In the preferred embodiment of FIG. 2A, the undulated midstratum layer 53 is further shown as being comprised of a paperboard material having relatively longer fiber lengths 70 as compared to the shorter fiber lengths 60 shown in the overlayer 51 and the underlayer 52.

Figure 2B:
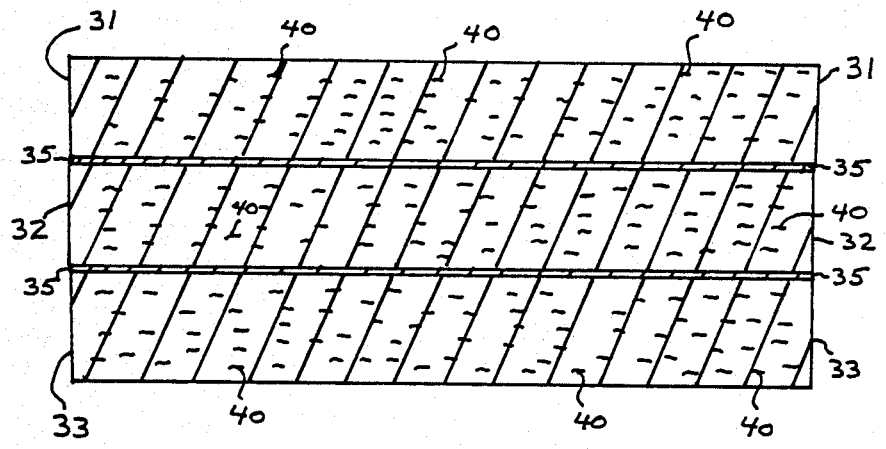
FIG. 2B. PRIOR ART
FIG. 2B is a view, similar to FIG. 2A, which illustrates the prior art solid laminated chipboard construction currently used for game boards.
Figure 1:
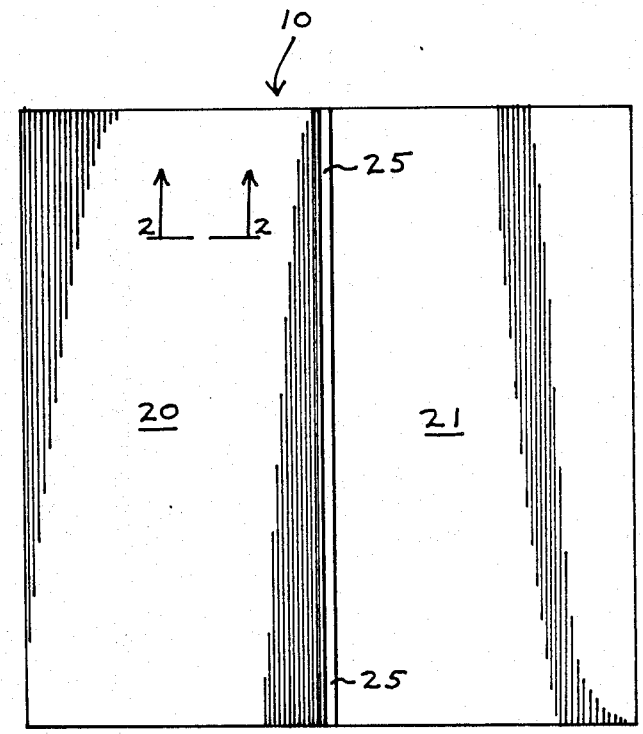
FIG. 1 is a plan view of the game board structure generally used in the industry.

By reason of the construction of FIG. 2A, it is seen that air cells or spaces 55 are formed internally of the game board structure thus reducing the materials cost in the overall manufacture of the present design. In effect, air spaces are used in place of the chipboard product. It is also apparent that the amount of adhesives 58, 59 required by the inventor's design is greatly reduced as compared to the adhesive requirements shown at 35 of prior art FIG. 2B.

While very significantly reducing manufacturing costs, the inventor herein has also discovered that a superior end product is produced. The longer fiber length 70 materials used in the undulating midstratum layer result in a greater original position memory for the overall structure—i.e. it tends to spring back to its original desired flat position if bent as contrasted to the low memory solid chipboard (FIG. 2B) which tends to crack if bent from its desired flat position.

The undulated shape of the midstratum layer also produces a spring-like effect for the overall game board 50 so that it is more resilient when subject to bending or other potentially destructive usages.

From the foregoing, it will be appreciated by those of skill in the art that the present invention greatly reduces materials costs and product production time. The weight of the end product game board is significantly reduced, thus reducing shipping costs. A thick and durable game board structure is achieved by substituting air spaces and an undulated midstratum layer for the more costly chipboard.

It is further highly significant that, relative to the prior art, the caliper or thickness of a panel may be increased without adding weight to the unit by reason of the air cell structure of the present invention.

As will be appreciated, a ½-inch thick panel formed utilizing the principles of the invention herein weighs significantly less than a solid ½-inch chipboard panel, thus reducing shipping weight and cost while increasing product durability.

It is contemplated that adhesives cost savings on the order of 75 percent may be realized by use of the present invention. Further, the use of a product having less internal adhesives results in longer product warpage as compared to chipboard panel systems heretofore known in the art.

Finally, the product is more resilient and less susceptible to the cracking problems inherent in the prior art solid laminated chipboard designs.

In practice of the invention, it is contemplated that the fibers 60 shown in the over and under chipboard layers 51 and 52 would have an average fiber length of 2 mm or less. It is further contemplated that the fibers 70 in the undulating midstratum layer 53 would have an average fiber length of at least 5 mm or more with the possibility of ranging up to 25 mm or more if a higher quality kraft process paper is utilized as the midstratum layer 53.

It is again emphasized that overall product weight and cost are reduced by reason of the air cells 55 which reduce the number of chipboard layers required in a game board construction. Simultaneously, the durability of the overall game board 50 is dramatically increased by reason of the undulating midstratum layer 53 and the relatively longer fiber lengths 70 contained therein which, as has been noted, improve the original position memory of the overall panel 50.

While there has been illustrated and described what is at present considered to be a preferred embodiment of the present invention it will be apprecaited that numerous changes and modifications are likely to occur to those skilled in the art, and it is intended herein to cover all those changes and modifications which fall within the true spirit and scope of the present invention.

I claim:

1. A game board structure (10) having a solid left panel (20), a solid right panel (21) and a foldable middle section (25), said panels (50) having an overlayer (51) comprised of chipboard material having relatively shorter fiber lengths (60) contained therein, said chipboard material being solid and devoid of perforations or apertures, said panels having an underlayer (52) comprised of chipboard material having relatively shorter fiber lengths (60) contained therein, said chipboard material being solid and devoid of perforations or apertures, said panels further having an undulating midstratum layer (53) between said overlayer (51) and underlayer (52), wherein the upper undulation portions of said midstratum layer (53) are secured directly to said overlayer (51) by adhesive means (58), and wherein the lower undulation portions of said midstratum layer (53) are secured directly to said underlayer (52) by adhesive means (59), said panels providing means wherein air cells (55) are formed internally thereof such that a given game board caliper or thickness may be maintained while reducing the number of chipboard layers required for construction, wherein said undulating midstratum layer (53) has relatively longer fiber lengths (70) contained therein as compared to the relatively shorter fiber lengths (60) contained in said overlayer (51) and said underlayer (52), wherein the average fiber length (60) of said overlayer (51) and said underlayer (52) is two millimeters or less, wherein the average fiber length (70) of said undulating midstratum layer (53) is five millimeters or more, wherein said air cells (55) are formed between said overlayer (51) and said underlayer (52) by way of said undulating midstratum layer (53) such that the overall weight of a panel (50) is reduced while improving panel strength via the spring-like effect of said midstratum layer and by the relatively longer fiber lengths (70) contained in said midstratum layer.

* * * * *